US008397622B2

(12) United States Patent
Fowler, IV et al.

(10) Patent No.: US 8,397,622 B2
(45) Date of Patent: Mar. 19, 2013

(54) BI-DIRECTIONAL AMMUNITION LIFTER

(75) Inventors: Robert J. Fowler, IV, Fredericksburg, VA (US); Carter G. Timberlake, Colonial Beach, VA (US); Michael M. Canaday, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 13/134,485

(22) Filed: May 25, 2011

(65) Prior Publication Data

US 2012/0312153 A1 Dec. 13, 2012

(51) Int. Cl.
*F41A 9/00* (2006.01)

(52) U.S. Cl. ..... 89/46; 89/45

(58) Field of Classification Search ..... 89/45–47
See application file for complete search history.

(56) References Cited

U.S. PATENT DOCUMENTS

| | | | | |
|---|---|---|---|---|
| 260,834 | A | 7/1882 | Brown et al. | |
| 376,584 | A | 1/1888 | Cone | |
| 2,855,828 | A * | 10/1958 | Girouard et al. | 89/45 |
| 4,631,988 | A | 12/1986 | Colvin | 81/62 |
| 5,007,611 | A | 4/1991 | Kanai | 248/422 |
| 5,215,287 | A | 6/1993 | Leski | 254/88 |
| 5,603,597 | A | 2/1997 | Clay, Sr. | 414/24.5 |
| 6,464,193 | B1 | 10/2002 | Nemoto | 248/421 |
| 6,530,782 | B2 * | 3/2003 | Fouse et al. | 434/19 |
| 6,666,423 | B1 | 12/2003 | Nemoto | 248/421 |
| 8,237,588 | B1 * | 8/2012 | Fowler et al. | 340/902 |
| 8,245,874 | B1 * | 8/2012 | Fowler, IV | 220/812 |
| 2002/0123025 | A1 * | 9/2002 | Fouse et al. | 434/19 |

* cited by examiner

*Primary Examiner* — Michael David
(74) *Attorney, Agent, or Firm* — Gerhard W. Thielman, Esq

(57) ABSTRACT

An ammunition elevator device is provided for raising and lowering ammunition. The device includes a housing, a crank assembly, a pawl mechanism, and a transfer linkage. The housing has a chamber flanked by first and second flanges. The assembly includes a crank axle, first and second sprockets mounted to the axle for elevating the ammunition, and a ratchet gear mounted to the axle adjacent to the first flange. The pawl mechanism includes a pawl, a toggle and a pin spreader. The transfer linkage has a rotatable bar pivotably connected to the second flange, a rod that radially shifts relative to the crank axle in response to the sprockets, and a pair of rotatable joints. The ratchet gear connects to the axle adjacent the first flange, wherein the gear cyclically pivots the pawl for raising the toggle.

5 Claims, 10 Drawing Sheets

BI-DIRECTIONAL AMMUNITION LIFTER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to ammunition elevators. In particular, the invention relates to elevation mechanisms for controllably raising and lower ammunition into a magazine.

Reversible (i.e., bi-directional) ratchets are utilized to great extent in hand wrenches allowing for the tightening and loosening of nuts and bolts. A ratcheting wheel engages a pawl, both having a saw-tooth groove, and is rotated in either direction with a detent coming in contact with a ball plunger to prevent unintended backwards rotation. Reversible ratchet wrenches of the type discussed above and other similar wrenches are disclosed by U.S. Pat. Nos. 260,834, 376,584, 2,542,241, 2,701,977, 3,713,356, 4,485,700, 4,631,988, 6,543,316 and 6,644,148. Ammunition lifts are used for lifting ammunition from one height to another. These were first used around 1930 to lift ammunition to the weapon system.

The United States Navy has commissioned two class prototypes for a Littoral Combat Ship (LCS) intended for close shore fire support with inter-changeable weapons modules for select plug-and-fight missions. The Gun Mission Module (GMM) as an example for the surface warfare module package includes two turret-mounted, axis-stabilized chain guns that protrude above deck from a module cover, below which personnel can supply ammunition from storage containers.

SUMMARY

Conventional ammunition lifters yield disadvantages addressed by various exemplary embodiments of the present invention. In particular, various exemplary embodiments provide for a ammunition elevator device is provided for raising and lowering ammunition. The device includes a housing, a crank assembly, a pawl mechanism, and a transfer linkage. The housing has a chamber within which to elevate the ammunition flanked by first and second flanges.

In various exemplary embodiments, the assembly, rotatably disposed between the flanges, has a crank axle, first and second sprockets mounted to the axle for elevating the ammunition, and a ratchet gear mounted to the axle adjacent to the first flange. The pawl mechanism connects to the first flange and includes a pawl, a toggle and a pin spreader. The toggle connects to the pawl and mounts to the spreader.

In various exemplary embodiments, the transfer linkage has a rotatable bar pivotably connected to the second flange, a rod that radially shifts relative to the crank axle in response to the sprockets, and first and second rotatable joints. The first joint connects to the bar to the rod. The second joint connects the rod to the spreader. The ratchet gear connects to the axle adjacent the first flange, wherein the gear cyclically pivot the pawl for raising the toggle.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments enable safely transporting ammunition connected via links vertically from one height to another in either direction with a ratcheting mechanism. The conventional method for lowering ammunition for involves disengaging the ratchet. This practice leaves the operator exposed to a potential large mass, depending on the length of the chute, traveling at fast speeds, and thus constitutes a distinct hazard. Moreover, confinement of the spaces within a naval war vessel impedes movement therein. Various exemplary embodiments alleviate these ambulatory restrictions for raising ammunition to be loaded.

The Gun Mission Module (GMM) for the Littoral Combat Ship (LCS) incorporates an ammunition lift that provides bi-directional raising of ratchet wrenches. Various exemplary embodiments comprise a ratchet wheel secured to a rotating shaft via a woodruff key as well as a nut and washer. The ratchet wheel engages a pawl, of mirrored proportions rotating about a pin a fixed distance from the shaft and secured in like manner as the ratchet wheel and having a spring affixed atop its center, thus acting in a ratcheting motion when rotated in either direction.

Two sprockets of equal size and shape having grooves to fit the diameter of the desired ammunition are fixed on the shafts in the manner as the ratchet wheel. As the shaft rotates the sprockets lift or lower the linked ammunition. The ammunition is kept free of jamming by guiding rails spaced at intervals dependent on the geometry of the ammunition.

Figure 1:
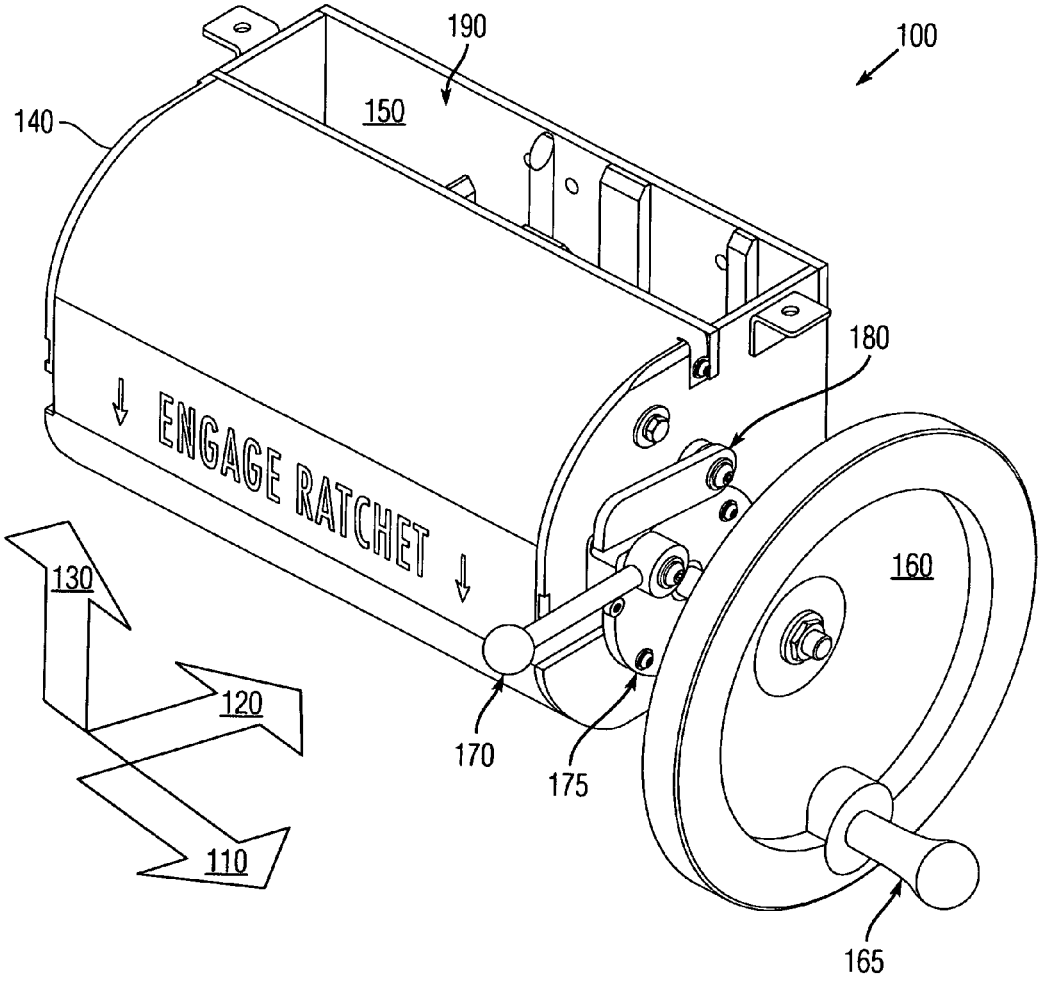
FIG. 1 is an isometric assembly view of an ammunition lifter.

FIG. 1 represents an isometric assembly view of an exemplary ammunition lift device 100. Arrows depict orientation relating to the hardware for axial 110, lateral 120 and zenith 130 directions. A housing for the lift device includes a cover 140 and a frame weldment 150. A manual wheel 160 with an attached crank handle 165 connects to an axle assembly for operating the lift device. A ratchet toggle 170 connected to a (distal) shaft collar 175 enables engagement of a ratchet lock 180. The weldment 150 defines a chamber 190 through which the ammunition passes.

The axle assembly, discussed in further detail below, represents a right-hand version, with the wheel 160 disposed at the distal end of the frame weldment 150. An operator can grab the handle 165 to turn the wheel 160 for lowering ammunition into the weldment 150. Artisans of ordinary skill will recognize that the wheel 160 with its handle 165 can be replaced with a powered motor without departing from the scope of the claims.

Figure 2A:
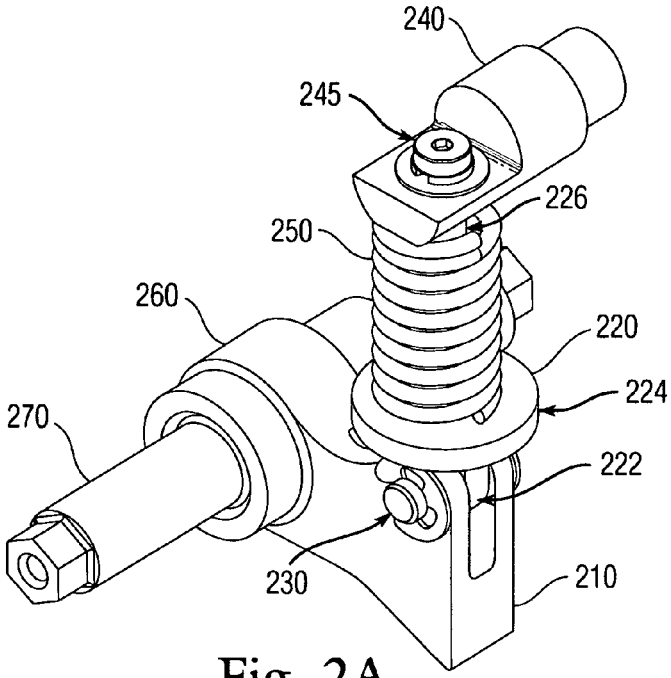
FIGS. 2A and 2B are isometric and elevation views of a toggle assembly.
Figure 2B:
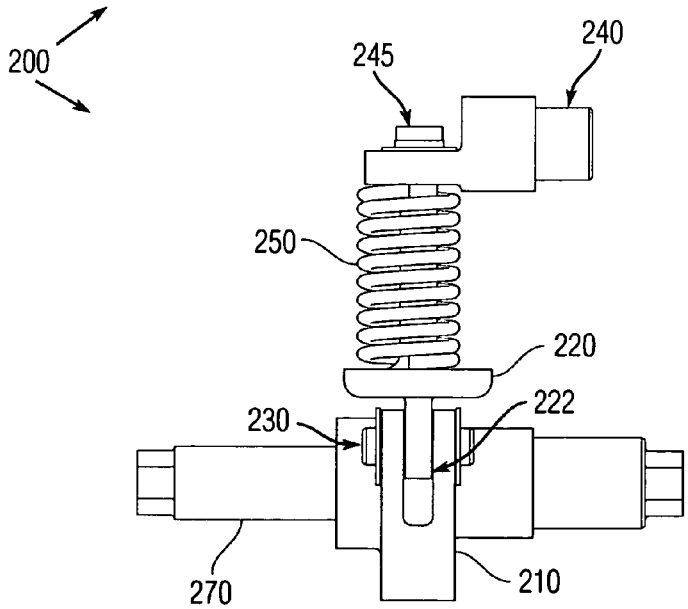

FIGS. 2A and 2B represent respective isometric and elevation views of a toggle assembly 200. A pawl 210 engages a pawl toggle 220 for lifting ammunition. The toggle 220 includes a pin joint 222 that connects to the pawl 210, a base 224, and a rod 226 that extends from the base 224. A pin 230 pivotably secures the toggle 220 at the joint 222 to the pawl 210. Opposite the pawl 210, the toggle 220 connects to the pin spreader 240 by a screw 245 surrounded by a helical spring 250 disposed between the base 224 and the screw 245. A sleeve 260 on the pawl 210 coaxially surrounds a pawl shaft 270 to pivot thereround.

Figure 3:
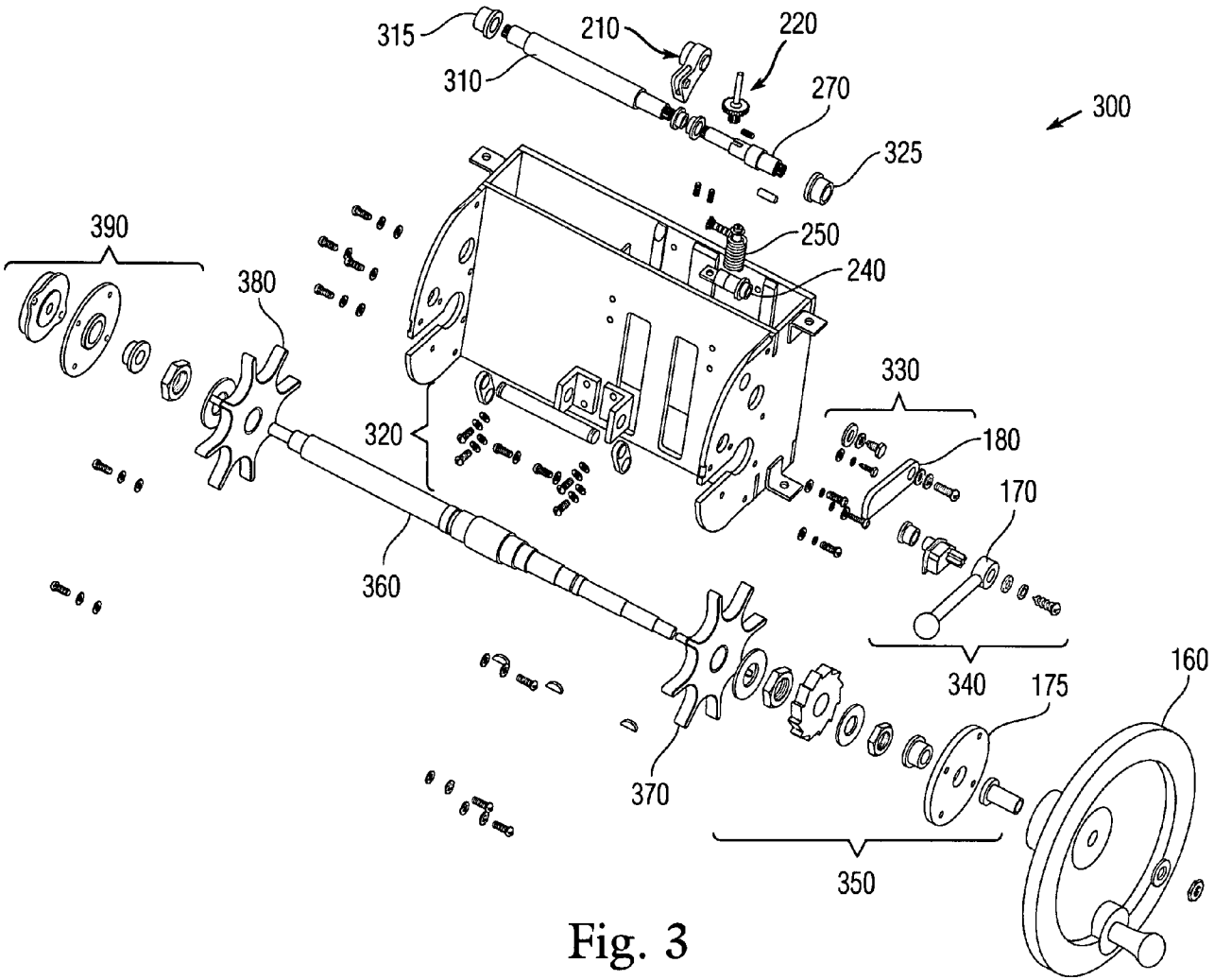
FIG. 3 is an isometric exploded view of the ammunition lifter.

FIG. 3 represents an isometric exploded view 300 of the ammunition lift device 100 in substantially the same orientation as the assembly view. An extender bar 310 terminates in a proximal sleeve bearing 315 and connects collinearly with the shaft 270. Transfer mechanism components 320 provide rotatable linkage between the bar 310 and the shaft 270, which terminates in a distal sleeve bearing 325. The pawl 220 is disposed at the upper portion of the weldment 150 between the bar 310 and the (upper distal) pawl shaft 270, which engages the pawl toggle 220. The helical compression spring 250 extends coaxially with the toggle 220, which terminates with a pin spreader 240 opposite its pin connection with the pawl 220.

The ratchet lock 180 connects to the frame weldment 150 by lock fastening components 330. The ratchet toggle 170 connects to the weldment 150 by toggle fastening components 340. A set of spacer and alignment components 350 connects the collar 175 and the wheel 160 to a crank axle 360. Distal and proximal sprockets 370, 380 mount to the crank axle 360, which terminates by a proximal damper assembly 390.

Figure 4:
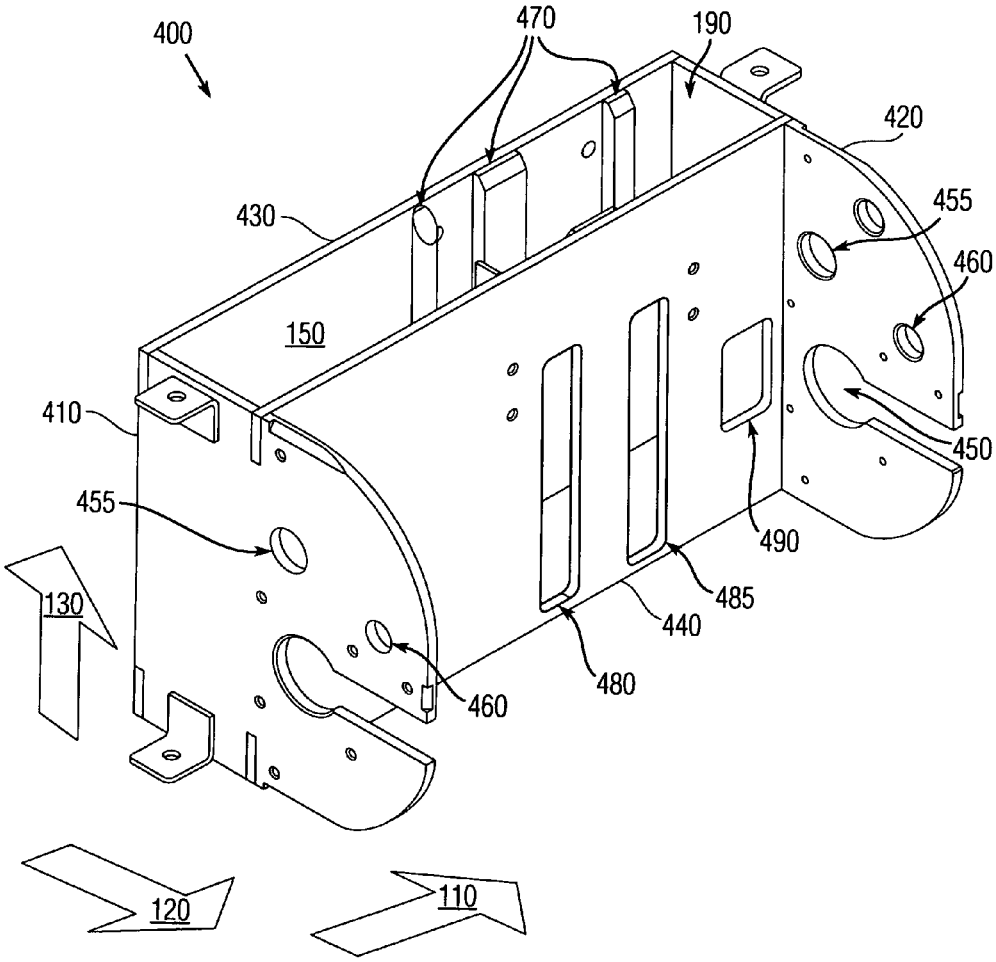
FIG. 4 is an isometric view of a frame weldment.

FIG. 4 represents an isometric view 400 of the frame weldment 150 for the ammunition lift device 100. The orientation in relation to the assembly view conforms to the arrows 110, 120 and 130 as shown. Proximal and distal flanges 410, 420 attach to port and starboard plates 430, 440 that define the chamber 190. Each flange 410, 420 includes a shaft keyslot 450 for supporting the crank axle 360 and through-holes 455, 460 for mounting additional components.

For the configuration shown, the flanges 410 and 420, each 0.25 inch in thickness, have longitudinal separation (axial direction 110) by 12.75 inches. Their width and height (lateral and zenith directions 120, 130) are 7.25 and 8.00 inches, respectively. Similarly, the plates 430 and 440 have chamber separation (lateral direction 120) of 2.00 inches for passing 30 mm ammunition. Artisans of ordinary skill will recognize that the dimensions provided for this configuration as described are exemplary only and not limiting to the sizes and types of munition rounds on which the exemplary embodiments can operate.

In particular, the pawl shaft 270 passes the through-hole 455, and the toggle fastening components 340 for the ratchet toggle 170 connect through the hole 460. The interior surfaces of the plates 430, 440 include alignment guide rails 470 for vertically sliding components therein. The starboard plate 440 includes first, second and third slots 480, 485 and 490. The ammunition rounds can be raised or lowered within the chamber 190 as the connecting links traverse along the guide rails 470.

Figure 5:
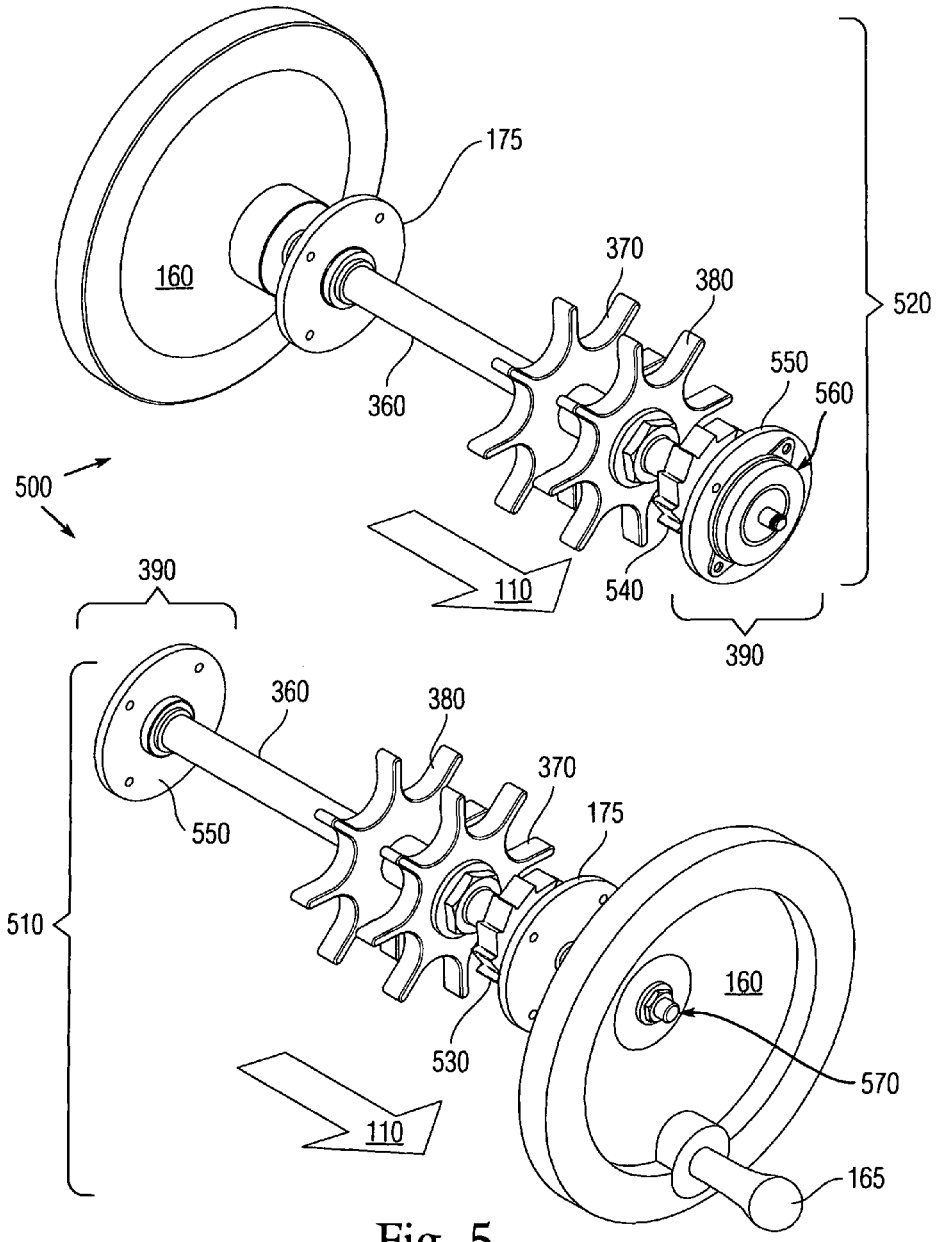
FIG. 5 is an isometric view of right- and left-hand axle assemblies.

FIG. 5 shows an isometric view 500 of right- and left-hand axle assemblies 510, 520 (respectively) with similar components. Components can be preferably produced from ASTM A322 steel having grade 8630 and Rockwell hardness of C40 to C50. Both right- and left-hand assemblies show the axial arrow 110 towards the right. The right-hand assembly 510 features the wheel 160 at the distal end, whereas the left-hand assembly 520 features the wheel 160 at the proximal end.

The right-hand assembly 510 includes a counter-clockwise ratchet gear 530 disposed along the shaft 360 between the collar 175 and the distal sprocket 370. The left-hand assembly 520 includes a clockwise ratchet gear 540 disposed along the shaft 360 between the proximal sprocket 380 and the damper assembly 390 that includes a spindle cover 550 and a unidirectional damper 560. As an alternative, the gear can incorporate axi-symmetric teeth for ratchet restriction using a pivotable ratchet toggle to restrict turning motion to a preferred direction.

The wheel 160 attaches to the shaft 360 by a wheel nut 570. The alternative axle assemblies 510, 520 can be installed through the keyslot 450 for either the right- or left-hand configuration, depending on which of the proximal or distal flanges 410, 420 on the frame weldment 150 that the wheel 160, toggle 170 and lock 180 are to be mounted.

The proximal and distal sprockets 380 and 370 penetrate into the chamber 190 through the respective first and second slots 480 and 485, with their teeth engaging the ammunition rounds. The gear 530 or 540 protrudes into the chamber 190 through the third slot 490. The damper 560 enables an operator to release the toggle 220 while restraining the ammunition within the chamber 190 from precipitously falling out therefrom.

Figure 6A:
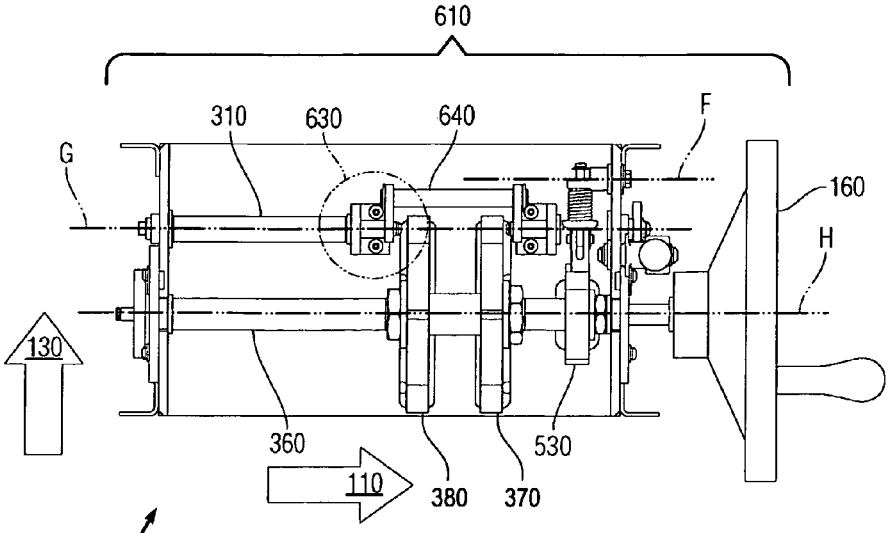
FIGS. 6A and B are elevation views of right- and left-hand lifters.
Figure 6B:
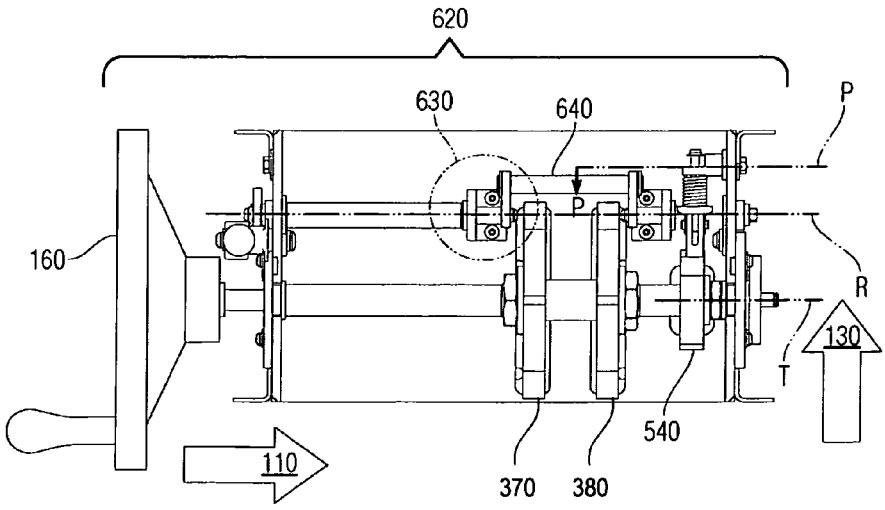

FIGS. 6A and 6B present elevation views 600 of right- and left-hand lifters 610, 620 (respectively and corresponding to assemblies 510, 520). The right-hand lifter 610 features the wheel 160 at the distal end adjacent the counter-clockwise ratchet gear 530 that rotates on axis H, whereas the left-hand lifter 620 features the wheel 160 at the proximal end opposite the clockwise ratchet gear 540 that rotates on axes T, as indicated by the respective axial and zenith directional arrows 110, 130.

A sprocket linkage joint 630 connects the extender bar 310 to a transfer rod 640 that shifts radially outward from the crank axle 360 as the sprockets 370, 380 turn. An opposing linkage connects the extender bar 310 along axes G and R to the pawl shaft 270. The transfer rod 640 and extender bar 310 enable support for the pawl 210 to pivot on the pawl shaft 270 along axes F and P without interfering with movement of the sprocketes 370, 380.

In left hand configuration 620, the linkage joint 630 connects the extender bar 310 to a transfer rod 640 that transmits radial motion from the toggle 170 to the pawl 210. The toggle 170 is locked in place in both right- and left-hand configurations by ratchet lock 180.

Locking the toggle 170 in position by the ratchet lock 180 prevents the pawl 210 from coming into contact with the ratchet gear 540. Thus gravity pulls the ammunition downward (opposite of 130). This engages the uni-directional damper 560 to retard the ammunition on its descent.

Figure 7:
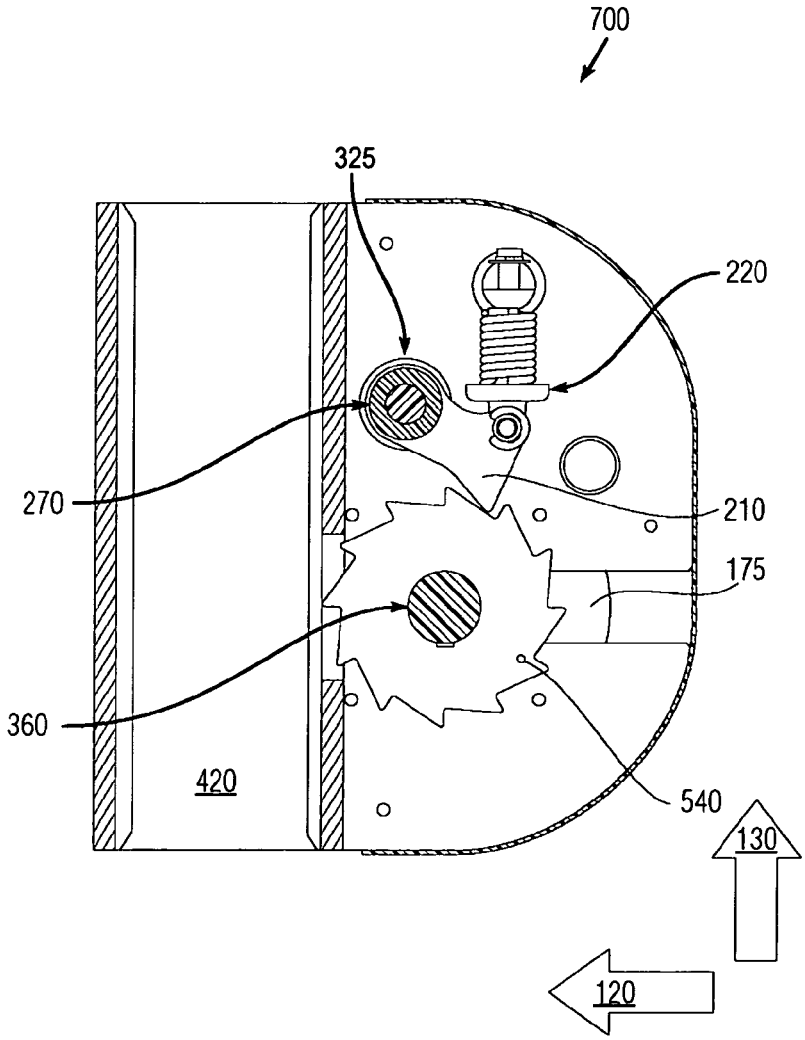
FIG. 7 is an elevation cross-section view of the left-hand lifter.

FIG. 7 represents an elevation view 700 of a left-hand lifter 620 as observed at the distal flange 420 from the proximal end looking forward (i.e., within the weldment 150), as indicated by the lateral and zenith directional arrows 120, 130. The pawl 210 pivots on the shaft 270 to move the toggle 220 vertically.

The clockwise ratchet gear 540 restricts the pawl 210 to gradual upward or else abrupt downward motion. (The counter-clockwise ratchet gear 530 similarly restricts the pawl 210 for the right-hand lifter 610 on the distal flange 420.) The bearing 325 pivotably maintains the shaft 270 within the hole 455 in the distal flange 420, while the bar 310 connects to the hole 455 in the proximal flange 410. The sprockets 370 and 380 rotate along the crank axle 360 in conjunction with the gear 540.

Figure 8:
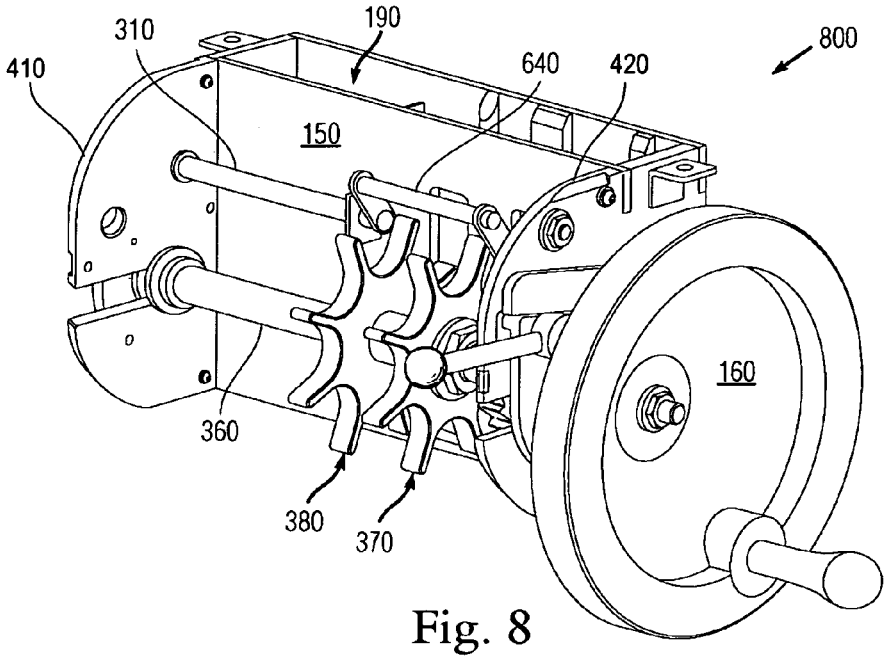
FIG. 8 is an isometric of the ammunition lifter without the cover.

FIG. 8 represents an elevation view 800 of the ammunition lift device 100 without the cover 140 for the frame weldment 150. The crank axle 360, having the gears 370, 380 attached thereon, is disposed within the keyslot 450 of the opposing flanges 410, 420. The extender bar 310 connects between the through-hole 455 of the proximal flange 410 and the linkage joint 630 for the transfer rod 640.

Figure 9:
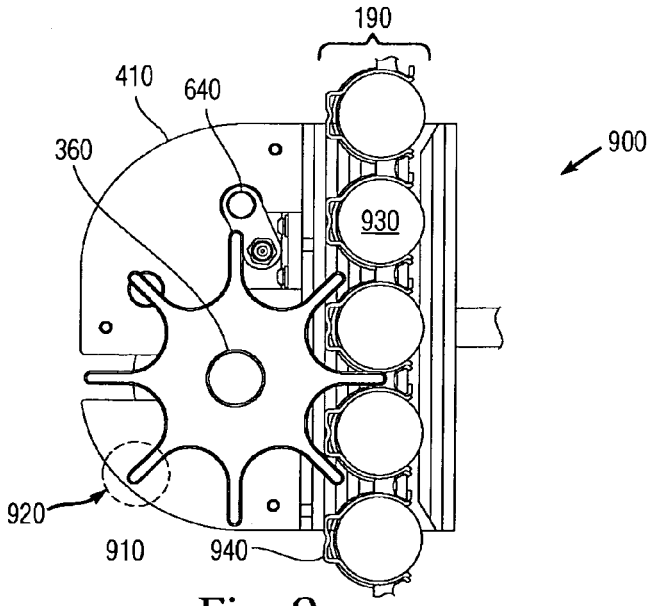
FIG. 9 is an elevation cross-section view of the right-hand lifter.

FIG. 9 represents an elevation view 900 of a right-hand lifter 610 as observed at the proximal flange 410 from the distal end looking aft (i.e., within the weldment 150). As the gears 370 and 380 turn counter-clockwise 910 on the crank axle 360, their sprocket teeth 920 protrude through the respective slots 485 and 480. The teeth 920 raise concatenated rounds 930 of 30 mm ammunition by engaging their links 940 upward through the chamber 190.

Figure 10:
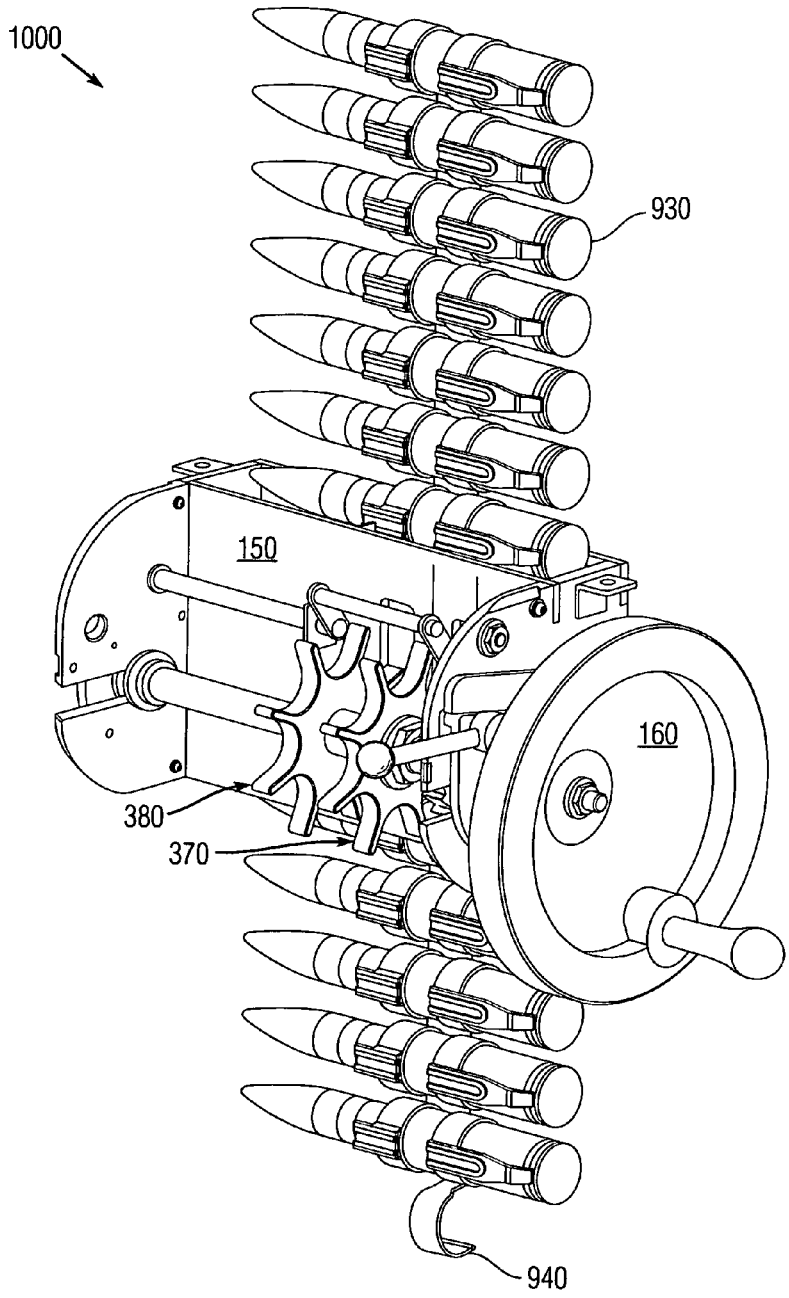
FIG. 10 is an isometric view of the lifter raising ammunition.
Figure 11:
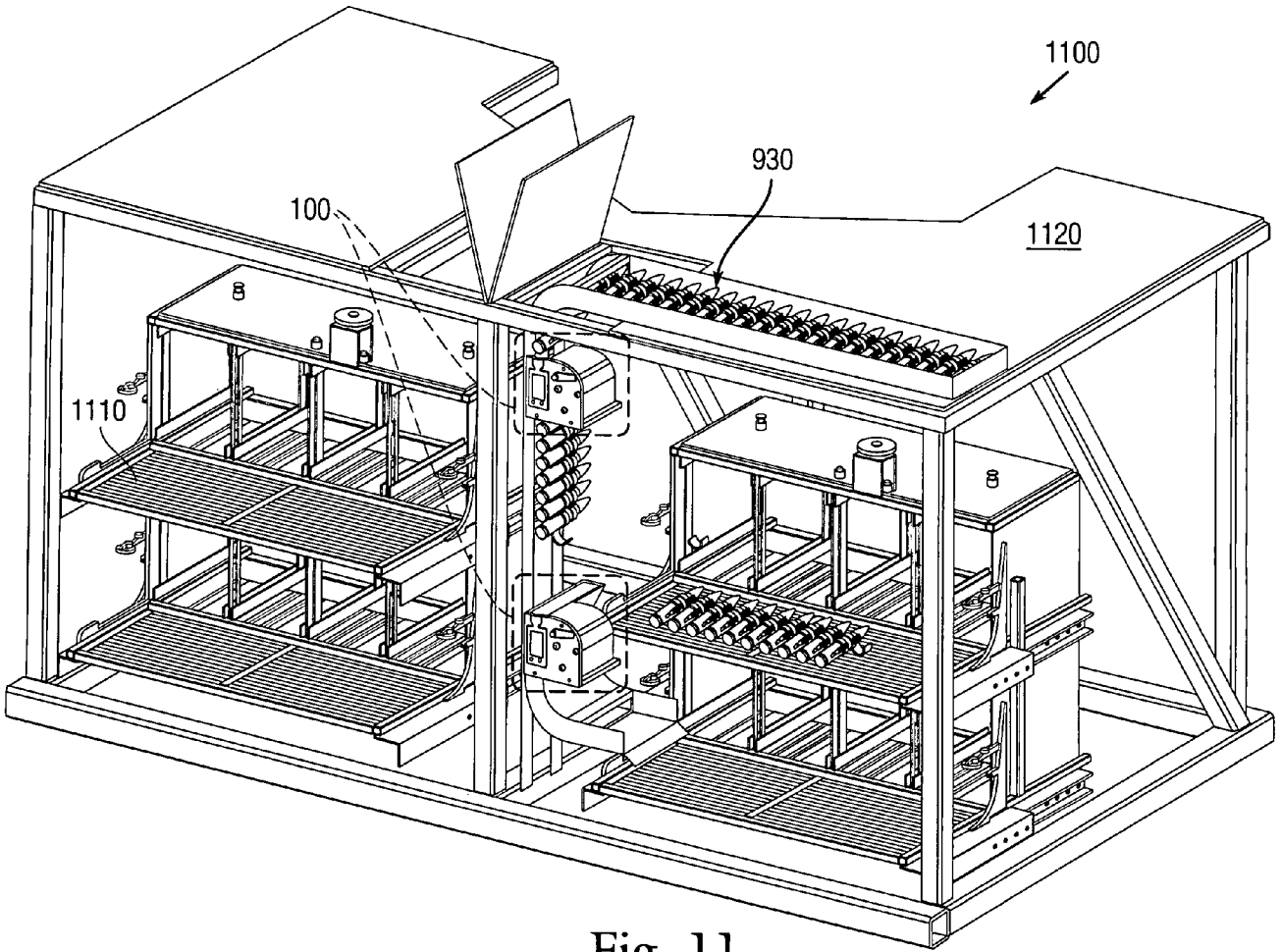
FIG. 11 is an isometric view of a storage locker frame for the gun mission module.

FIG. 10 represents an isometric view 1000 of the ammunition lift device 100 (without the cover 140) lifting concatenated rounds 930 through the chamber 190. FIG. 11 represents an isometric view 1100 of a storage locker frame around the GMM equipped with upper and lower devices 100. This frame includes a munitions assembly platform 1110 (represented by an open fold-down door of a stowage magazine) from which at least one ammunition lifter 100 elevates the concatenated rounds 930 to a loading platform 1120 for the chain gun.

Various exemplary embodiments of the ammunition lifter feature advantages such as a safety mechanism for bi-directional use. By lifting the ratchet toggle handle 170 (e.g., via an operator), the ratchet lock 180 pushes upwards, disengaging the toggle pawl assembly 200 from the ratchet gear 530, 540. Gravity then pulls the ammunition rounds downward, which engages the uni-directional damper 560 to apply friction that retards the descent of the rounds. The ammunition 930 then can be lowered at a controlled rate to the lower level without potential injury to the operator. The ratchet gear 530, 540 engaged with the pawl 210 provides for improvements in safety by restricting motion to the intended (descent) direction.

Another advantage from various exemplary embodiments constitutes the mirror design features. In particular, the assembly for the crank axle 360 can be installed within the weldment 150 with the wheel 160 mounted on either the distal plate 420 in the right-hand configuration 510 or else on the proximal plate 410 in the left-hand configuration 520, as a reversal to the right-hand configuration 510. This enables the operator to lift ammunition 930 from either end, such as a munitions round forward (as shown in view 1100), or alternatively a clip forward, thereby augmenting versatility.

This mirror complimentary feature may be necessitated due to the dual canister mirror loading style of the Mk46 chain gun for the GMM, and as such reduces operator reloading time and potential confusion. The transfer rod 640 and the extender bar 310 attach to the ratchet lock 180 so that the ammunition lift device 100 operates as shown in the assembled configuration. Typically, the pawl assembly 200 pivots about the hole 460 in the distal plate 420, although mounting to the corresponding position on the proximal plate 420 can also be accomplished.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An ammunition elevator device for raising and lowering ammunition, said device comprising:

a housing having a chamber within which to elevate the ammunition flanked by first and second flanges;

a crank assembly rotatably disposed between said flanges, said assembly having a crank axle, first and second sprockets mounted to said axle for elevating said ammunition, and a ratchet gear mounted to said axle adjacent to said first flange;

a pawl mechanism connected to said first flange, said mechanism having a pawl, a toggle and a pin spreader, said toggle connected to said pawl and mounted to said spreader; and a transfer linkage having a rotatable bar pivotably connected to said second flange, a rod that shifts radially relative to said crank axle in response to said sprockets, and first and second rotatable joints, said first joint connecting said bar to said rod, said second joint connecting said rod to said spreader, wherein said gear cyclically pivots said pawl for raising said toggle.

2. The device according to claim 1, further including a turning wheel mounted to said crank assembly for rotating said crank axle.

3. The device according to claim 2, further including a uni-directional damper disposed on said crank axle opposite to said wheel.

4. The device according to claim 1, wherein said ratchet gear restricts turning in one of a clockwise and a counter-clockwise direction.

5. The device according to claim 1, further including a ratchet lock for restraining said ratchet gear.

* * * * *